US011777196B1

(12) United States Patent
Blake et al.

(10) Patent No.: US 11,777,196 B1
(45) Date of Patent: Oct. 3, 2023

(54) APPARATUS AND METHODS FOR WIRELESS COMMUNICATIONS ANTENNA INCLUDED WITHIN A WEARABLE ELECTRONIC DEVICE

(71) Applicant: Barking Labs Corp., New York, NY (US)

(72) Inventors: Robert J. Blake, Purchase, NY (US); Stephen L. Snyder, Bedford, MA (US); Shiann S. Yamin, Warren, NJ (US); Jonathan R. Bensamoun, New York, NY (US)

(73) Assignee: Barking Labs Corp., New York, NY (US)

( * ) Notice: Subject to any disclaimer, the term of this patent is extended or adjusted under 35 U.S.C. 154(b) by 0 days.

(21) Appl. No.: 18/054,808

(22) Filed: Nov. 11, 2022

(51) Int. Cl.
*H01Q 1/27* (2006.01)
*H01Q 1/38* (2006.01)

(52) U.S. Cl.
CPC ..... *H01Q 1/273* (2013.01); *H01Q 1/38* (2013.01)

(58) Field of Classification Search
CPC ..... H01Q 1/273; H01Q 1/38; H01Q 1/241; G04G 21/04
See application file for complete search history.

(56) References Cited

U.S. PATENT DOCUMENTS 4,754,285 A * 6/1988 Robitaille ..... H01Q 1/273 343/718
5,144,325 A * 9/1992 Kurcbart ..... H01Q 1/273 343/718
2006/0001583 A1* 1/2006 Bisig ..... H01Q 1/273 343/866
2022/0291393 A1* 9/2022 Gum ..... G01S 19/19

* cited by examiner

*Primary Examiner* — David E Lotter
(74) *Attorney, Agent, or Firm* — COOLEY LLP

(57) ABSTRACT

Embodiments of a wireless communications antenna of a wearable electronic device, and method of its use are described herein. An apparatus can comprise a housing having top and bottom portions, a printed circuit board (PCB), a metal frame, and a band. The top portion of the housing can include an antenna element, which can be conductively coupled to the PCB. The metal frame can have a first coupler and a second coupler. The PCB can be disposed between, and not conductively coupled to, the housing and the metal frame. The band can have first and second end portions, which can be conductively coupled to the frame when removably coupled to the first coupler and second coupler, respectively. The antenna element, the metal frame, and the first and second end portions of the band can collectively define an antenna having an antenna profile when the antenna is operational.

18 Claims, 8 Drawing Sheets

APPARATUS AND METHODS FOR WIRELESS COMMUNICATIONS ANTENNA INCLUDED WITHIN A WEARABLE ELECTRONIC DEVICE

CROSS-REFERENCE TO RELATED APPLICATION(S)

This application is related to U.S. patent application Ser. No. 18/054,779, entitled "Apparatus and Methods of Removably Attaching to a Band to a Wearable Electronic Device," and filed herewith, the entirety of which is incorporated by reference herein.

BACKGROUND

The embodiments described herein relate generally to apparatus and methods for a wireless communications antenna included within a wearable electronic device, and more particularly, to such apparatus and methods in which the wearable electronic device includes an antenna element, a metal frame, and end portions of a band that collectively define an antenna having an antenna profile when the antenna is operational.

Antenna configurations for small form electronics (such as wearable electronic devices) are quite difficult. In particular, when a piece of metal gets close enough to a radiofrequency trace of the electronic device, the metal starts to unintentionally become part of the antenna design, resulting in the antenna operating with an undesirable antenna profile. This can happen, for example, when a band for a wearable electronic device includes metal or metallic features.

Thus, a need exists for an antenna for a wearable electronic device that is configured to operate at a desired antenna profile when metal on a band for the wearable electronic device comes into proximity of or contact with the wearable electronic device.

SUMMARY

Embodiments of a wireless communications antenna included within a wearable electronic device, and method of its use are described herein. In some embodiments, an apparatus comprises a housing, a printed circuit board (PCB), a metal frame, and a band. The housing has a top portion and a bottom portion. The top portion of the housing can include an antenna element. The metal frame can have a first coupler and a second coupler. The PCB can be disposed between, and not conductively coupled to, the housing and the metal frame. The PCB can be conductively coupled to the antenna element. The band can have a first end portion and a second end portion. The first end portion of the band can be conductively coupled to the metal frame when removably coupled to the first coupler of the metal frame. The second end portion of the band can be conductively coupled to the metal frame when removably coupled to the second coupler of the metal frame. The antenna element, the metal frame, the first end portion of the band and the second end portion of the band can collectively define an antenna having an antenna profile when the antenna is operational.

DETAILED DESCRIPTION

Embodiments of a wireless communications antenna included within a wearable electronic device, and method of its use are described herein. The apparatus described herein can be used, for example, in tracking a geolocation or activity of a wearer, and more specifically for tracking the geolocation or activity of an animal (e.g., a dog or other pet).

Figure 1:
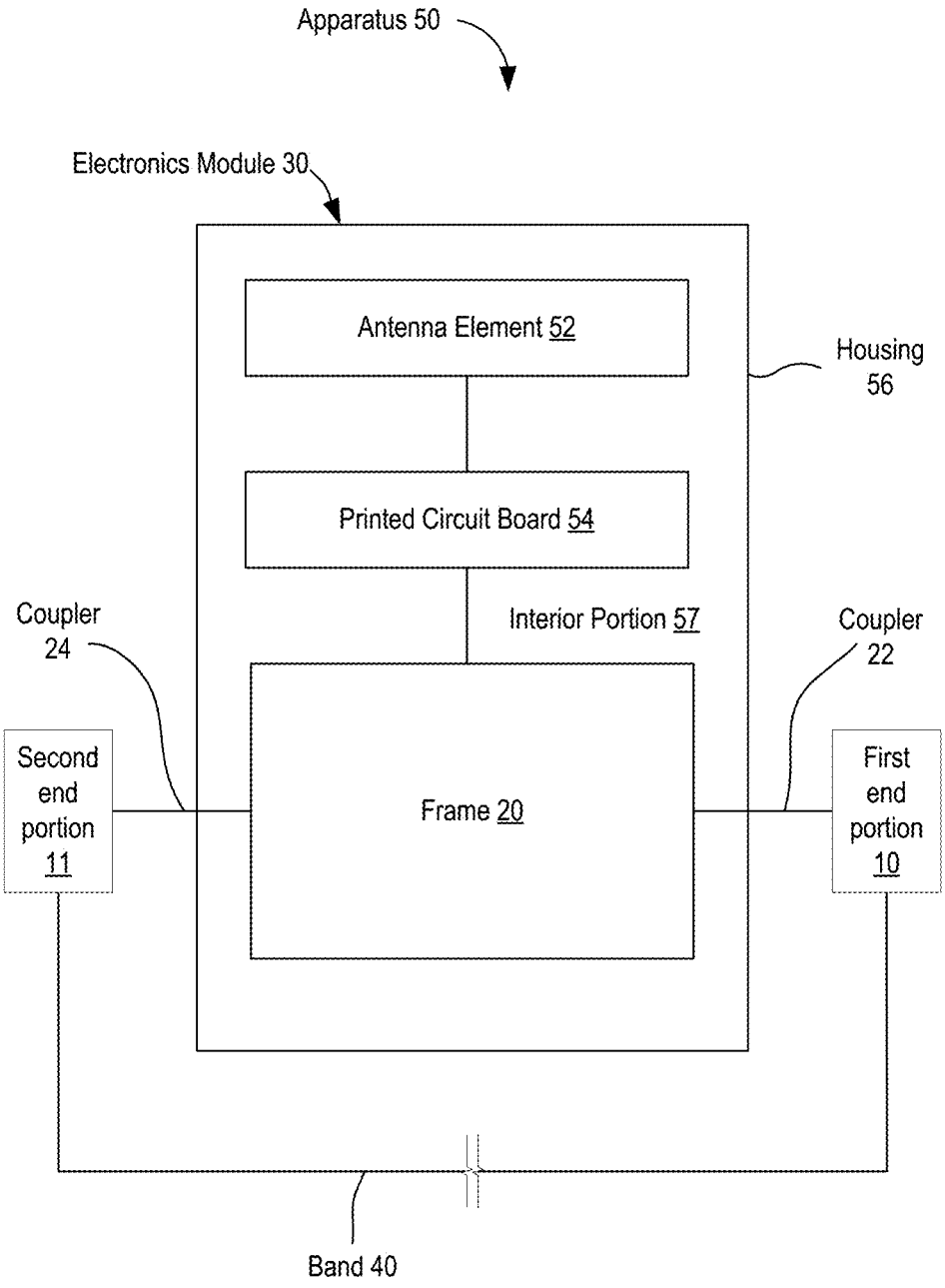
FIG. 1 is a schematic illustration of an apparatus, according to an embodiment.

An apparatus 50 according to an embodiment is schematically illustrated in FIG. 1. The apparatus 50 can be, for example, a wireless communications antenna included within a wearable electronic device, such as an electronic animal collar (or more specifically, an electronic dog or pet collar). Although the apparatus 50 is described herein as being included in an electronic animal or pet collar, in other embodiments, the apparatus 50 can be included in a different wearable electronic device, such as a watch (or smartwatch), an activity tracker, or the like.

The apparatus 50 can include an electronics module 30 and a band 40. The electronics module 30 can include a housing 56, a printed circuit board 54 ("PCB"), and a frame 20. The housing 56 can have a top portion, a bottom portion coupled to the top portion, and a side wall portion disposed between the top portion and the bottom portion. The top portion, the bottom portion and/or the side wall portion of the housing can collectively define an interior portion 57. The housing 56 can be constructed of any suitable material configured to be worn by a user. For example, in some embodiments, the housing 56 is non-metal, such as a plastic, silicone, rubber, leather, or the like. The electronics module 30 includes an antenna element 52. The PCB 54 and the antenna element 52 can be disposed between at least a portion of the housing 56 and the frame 20. The antenna element 52 can be trace printed, for example, onto an interior surface of the housing 56 (e.g., of the top portion or other portion of the housing).

The PCB 54 can be disposed in the interior portion 57 of the housing 56, such as between (and, optionally, not conductively coupled to) the housing 56 and/or the frame 20. The PCB 54 can be electrically or conductively coupled to the antenna element 52 included in the housing 56. In some embodiments, the PCB 54 can be inductively or capacitively coupleable to the antenna element 52. The frame 20 of the electronics module 30 can be at least partially disposed within the housing 56. In some embodiments, at least a portion of opposing sides or end portions of the frame 20 can be disposed exterior to the housing 56, and a different portion of the frame 20 between the opposing sides or end portions can be disposed within the interior portion 57 of the housing 56.

The opposing sides or end portions of the frame 20 can each include a coupler 22, 24. The coupler 22 (e.g., a first coupler) is configured to be coupled to a first end portion 10 of the band 40, and the coupler 24 (e.g., second coupler) is configured to be coupled to a second end portion 11 of the band 40. In some embodiments, each end portion 10, 11 of the band 40 includes a coupler (not shown in FIG. 1) that is sized and configured to be removably coupled to the electronics module 30, and more specifically to removably couple to a respective one of the couplers 22, 24 of the frame 20.

Each coupler 22, 24 can be configured to couple to the end portions 10, 11 of the band 40 so that the end portions 10, 11 can rotate with respect to the couplers 22, 24, respectively. The coupler 22, 24 can be or include, for example, an elongated post that is slidingly receivable in a channel defined by the end portions 10, 11, respectively, of the band 40. In some embodiments each coupler 22, 24 of the frame 20 has a predefined cross-sectional shape configured to ensure coupler 22 of the frame 20 can couple only to the first end portion 10 of the band 40 and not to the second end portion 11, and coupler 24 of the frame 20 can couple only to the second end portion 11 of the band 40 and not to the first end portion 10. For example, in some embodiments, each coupler 22, 24 is conical, is cylindrical, or includes a first portion having a first shape (e.g., conical) and a second, mutually-exclusive portion having a second shape (e.g., cylindrical) different from the first shape, and a channel defined by the end portions 10, 11 respectively, of the band 40 can have a shape complementary to a shape of the couplers 22, 24 to fully receive the couplers 22, 24 in the respective channel in a predetermined orientation. In some embodiments, the end portions 10, 11 of the band 40 are configured to couple to the frame 20 of the electronics module 30 only when the end portions 10, 11 of the band 40 are positioned at a predetermined angle with respect to the couplers 22, 24, respectively, of the frame 20.

The frame 20, or at least portions thereof (such as couplers 22, 24) can be constructed, for example, of metal. As such, the metal frame 20 can be electrically coupled to at least one of the antenna element 52 and the PCB 54, as described in more detail herein. The end portions 10, 11 of the band 40 can also each be constructed of metal. Thus, in some embodiments, the first end portion 10 (or a coupler thereof) of the band 40 is conductively coupled to the metal frame 20 when removably coupled to the first coupler 22 of the metal frame 20, and the second end portion 11 (or coupler thereof) of the band 11 is conductively coupled to the metal frame 20 when removably coupled to the second coupler 24 of the metal frame 20.

The antenna element 52, the metal frame 20, the first end portion 10 of the band 40 and the second end portion 11 of the band 40 can collectively define the antenna. The metal frame 20 can be conductively coupled to the antenna element 52 when the antenna is operational. Similarly, each of the first end portion 10 and the second end portion 11 of the band 40 can be conductively coupled to the antenna element 52 when the antenna is operational (e.g., when the electronics module 30 is powered on), and the end portions 10, 11 (or couplers thereof) of the band 40 are in sufficiently close proximity to or in contact with the electronics module 30, or frame 20 specifically.

In some embodiments, the antenna element 52 is electrically coupled to, but not directly in contact with, any one of the metal frame 20, the first end portion 10 of the band 40 and the second end portion 11 of the band 40, or a combination of the foregoing. In some embodiments, the metal frame 20, the first end portion 10 of the band 40 and the second end portion 11 of the band 40 are each indirectly electrically coupled to the antenna element 52. In some embodiments, any one of the metal frame 20, the first end portion 10 of the band 40 and the second end portion 11 of the band 40 can be inductively or capacitively coupled to the antenna element 52 when the antenna is operational. In some embodiments, the antenna element 52 is inductively, and not conductively, coupled to the metal frame 20, the first end portion 10 of the band 40 and the second end portion 11 of the band 40, collectively, or to any one of the foregoing individually.

The apparatus (or antenna) 50 can have a first configuration and a second configuration. In the first configuration, the first end portion 10 (or first coupler 100) of the band 40 is removably coupled to the first coupler 22 of the metal frame 20, and the second end portion 11 (or coupler thereof) of the band 40 is removably coupled to the second coupler 24 of the metal frame 20. In the second configuration, the first end portion 10 (or coupler thereof) of the band 40 is not coupled to (or is spaced apart from) the first coupler 22 of the metal frame 20, and the second end portion 11 (or coupler thereof) of the band 40 is not coupled to (or is spaced apart from) the second coupler 24 of the metal frame 20.

The antenna has an antenna profile when the antenna is operational. For example, the antenna, when operational, can have an antenna profile that includes a predetermined spatial radiation pattern, a predetermined frequency response (e.g., bandwidth) and a predetermined peak magnitude. In some embodiments, when the antenna is operational and is in the first configuration, the antenna has a first spatial radiation pattern and a first frequency response, which can include a first peak magnitude. The first spatial radiation pattern can represent, for example, directional (angular) strength of the output (and reception) of the antenna. The first frequency response can include, for example a predetermined frequency range (e.g., a first bandwidth), and the first peak magnitude can reflect a quality of the resonance (i.e., radiation efficiency). In use, for example, operation of the antenna in the first configuration can be sufficient or desirable to enable the antenna to transmit a signal to and/or receive a signal from a remote electronic device. In this manner, the antenna in the first configuration can be used for remote tracking of the geolocation of the wearable electronic device, such as Global Positioning System (GPS) tracking via a cellular tower, WiFi®, a smartphone, or other suitable system or remote electronic device.

In some implementations, when the antenna is operational and is in the second configuration, the antenna can have a second spatial radiation pattern and a second frequency response, which can include a second peak magnitude. The second spatial radiation pattern can represent, for example, directional (angular) strength of the output (and reception) of the antenna when in the second configuration. In some implementations, the second spatial radiation pattern and/or the second frequency response can include or correspond to, for example, the first spatial radiation pattern and/or the first frequency response. In other implementations, the second spatial radiation pattern and/or the second frequency response can be different from the first spatial radiation pattern and/or the first frequency response, such as having a different resonance quality and/or characteristic(s). For example, the second peak magnitude can be different from, such as less than, the first peak magnitude. As such, the second peak magnitude can reflect a lesser quality of resonance than the quality of resonance reflected by the first peak magnitude. In use, for example, operation of the antenna in the second configuration can be insufficient or undesirable for the antenna to transmit a signal to and/or receive a signal from a remote electronic device. In this manner, the antenna in the second configuration can interfere with remote tracking of the geolocation of the wearable electronic device.

The frame 20 can includes a cut-out portion (not shown in FIG. 1) pre-selected to tune a spatial radiation pattern and/or a frequency response of the antenna when the antenna is operational. Said another way, the cut-out portion can be sized and positioned to tune the spatial radiation pattern and/or the frequency response of the antenna, and particularly, the first spatial radiation pattern, the first frequency response and/or the first peak magnitude of the first frequency response of the antenna when the antenna is operational and in the first configuration.

In some embodiments, one or more portions of the electronics module 30 described herein (e.g., frame 20) can be monolithically constructed. For example, the couplers 22, 24 can be monolithically formed with a body portion of the frame 20 between the couplers 22, 24. In other embodiments, one or more portions of the frame 20 (e.g., the couplers 22, 24) can be separately formed or constructed and attached to the other portion(s) of the frame 20.

A portion of the band 40 between the first end portion 10 and the second end portion 11 of the band 40 can be, for example, constructed of a non-conductive material. The band 40 can include, for example, an elongate material between the first end portion 10 (or first coupler 100) and the second end portion 11 (or second coupler 101). The elongate material can be, for example, flexible. The elongate material can be any suitable material configured to be worn by a user, such as nylon, cotton, polyester, leather, or other suitable woven or non-woven material.

The band 40 can have an adjustable length. More specifically, the elongate material of the band 40 can be adjustable to a length. For example, the band 40 can include a buckle (e.g., ladder lock buckle), or the like, or any other suitable adjustment mechanism such as a hook and loop fastener, snaps, or the like, configured to enable a user to adjust a length of the band between the end portions 10, 11. The band 40 can include another buckle (not shown in FIG. 1) disposed between the first end portion 10 and the second end portion 11 that is configured to open the band 40 of the wearable electronic device for attaching to or donning by a user (e.g., without decoupling one of end portions 10, 11 from the coupler 22, 24, respectively).

The electronics module 30 can include additional components (not shown in FIG. 1), such as a battery, a charging coil coupled to the battery, electrical connectors or wires, a light source, each of which can be at least partially disposed in the interior portion 57 of the housing 56. The light source can be configured to provide an indicia of the operating state or condition of the electronics module 30, such as based on whether the light is on or off, the color of the light, or whether the light is static or blinking, or any combination of the foregoing.

Figure 2:
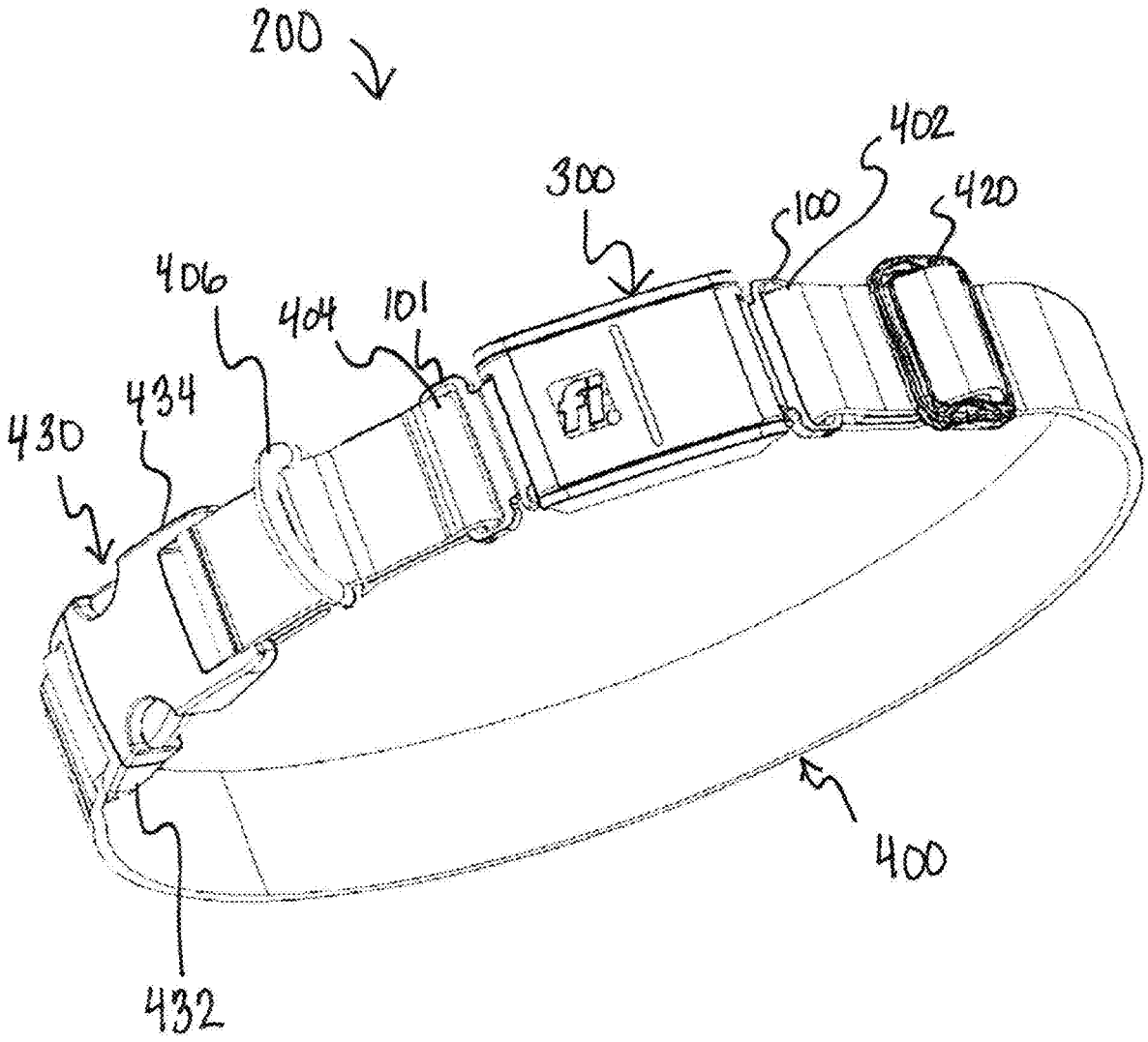
FIG. 2 is a perspective view of an apparatus, according to an embodiment, in a first configuration.
Figure 3:
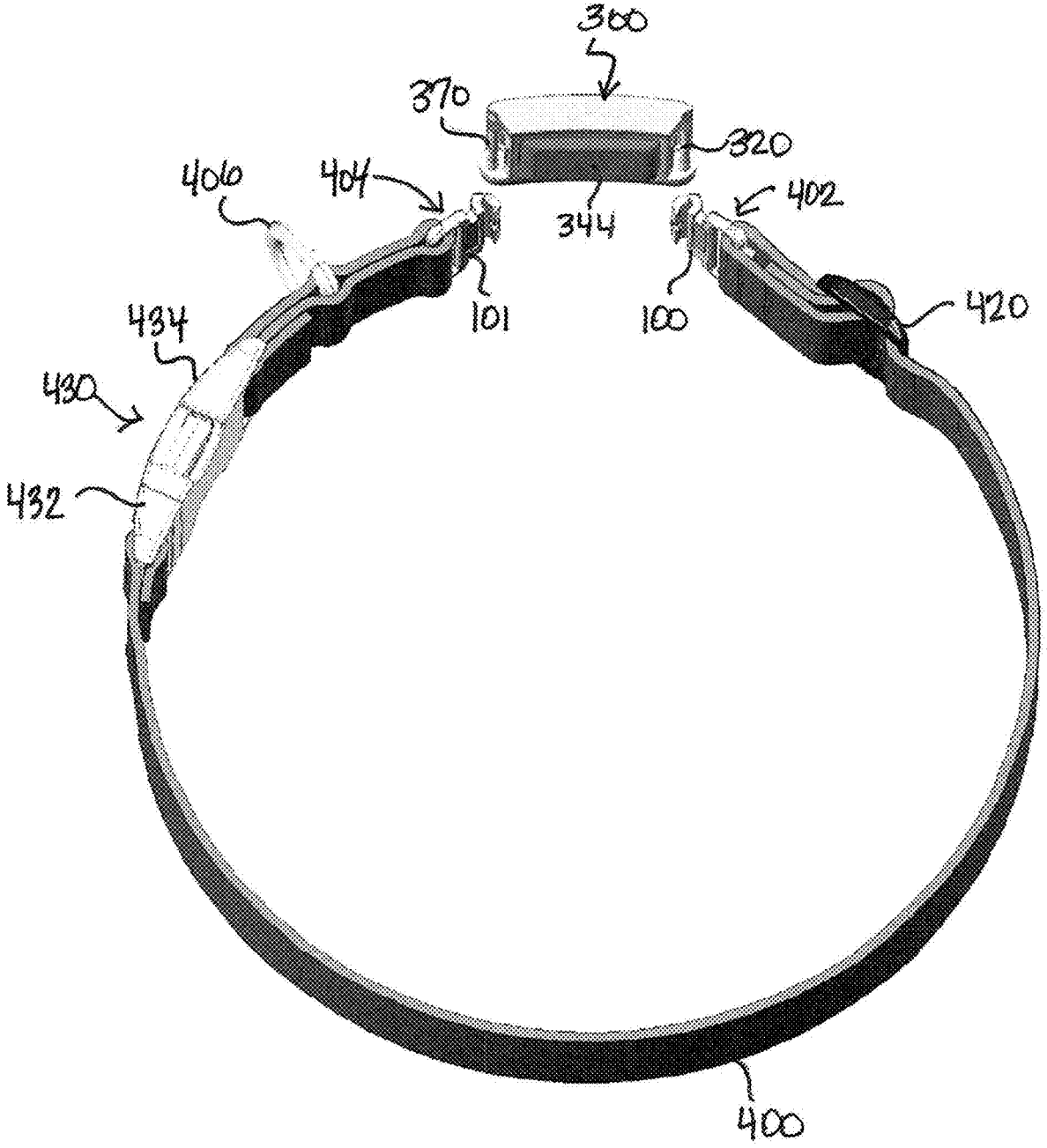
FIG. 3 is a bottom perspective view of the apparatus of FIG. 2, in a second configuration.
Figure 4:
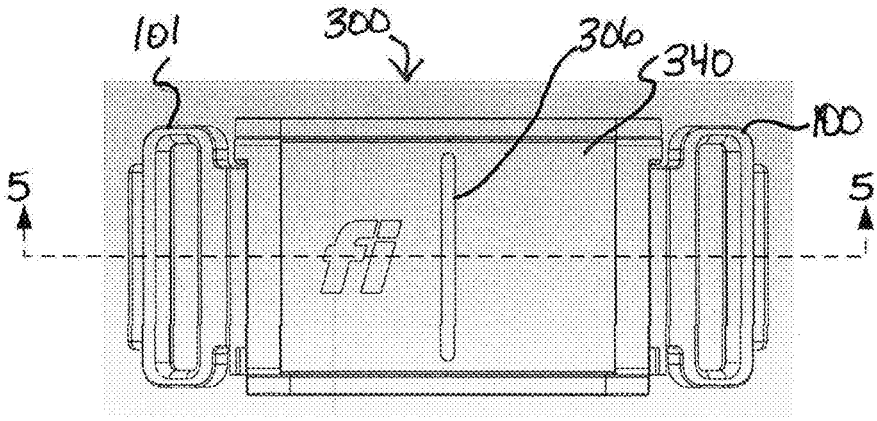
FIG. 4 is a top view of a portion of the apparatus of FIG. 2, with a band portion of the apparatus of FIG. 2 not shown for the sake of illustration.
Figure 5:
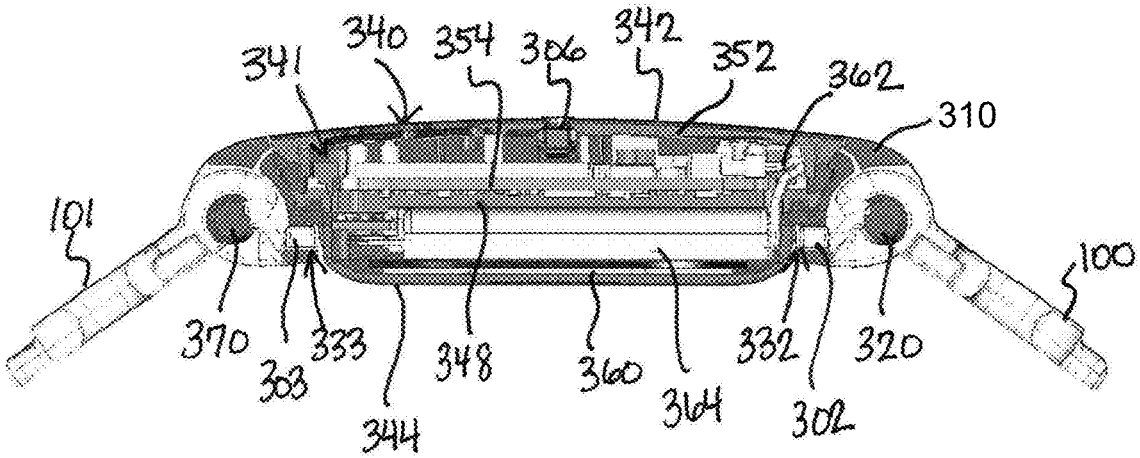
FIG. 5 is a cross-sectional view of the portion of the apparatus of FIG. 4, taken a long line 5-5 shown in FIG. 4.
Figure 6:
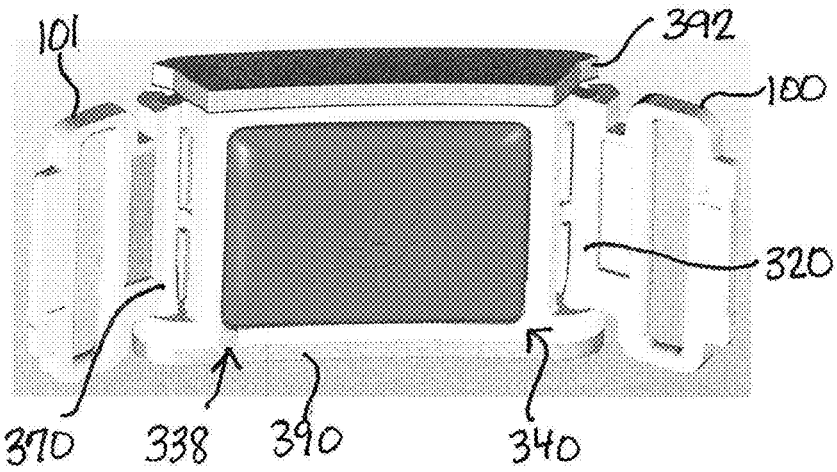
FIG. 6 is a bottom perspective view of the portion of the apparatus of FIG. 4.
Figure 7:
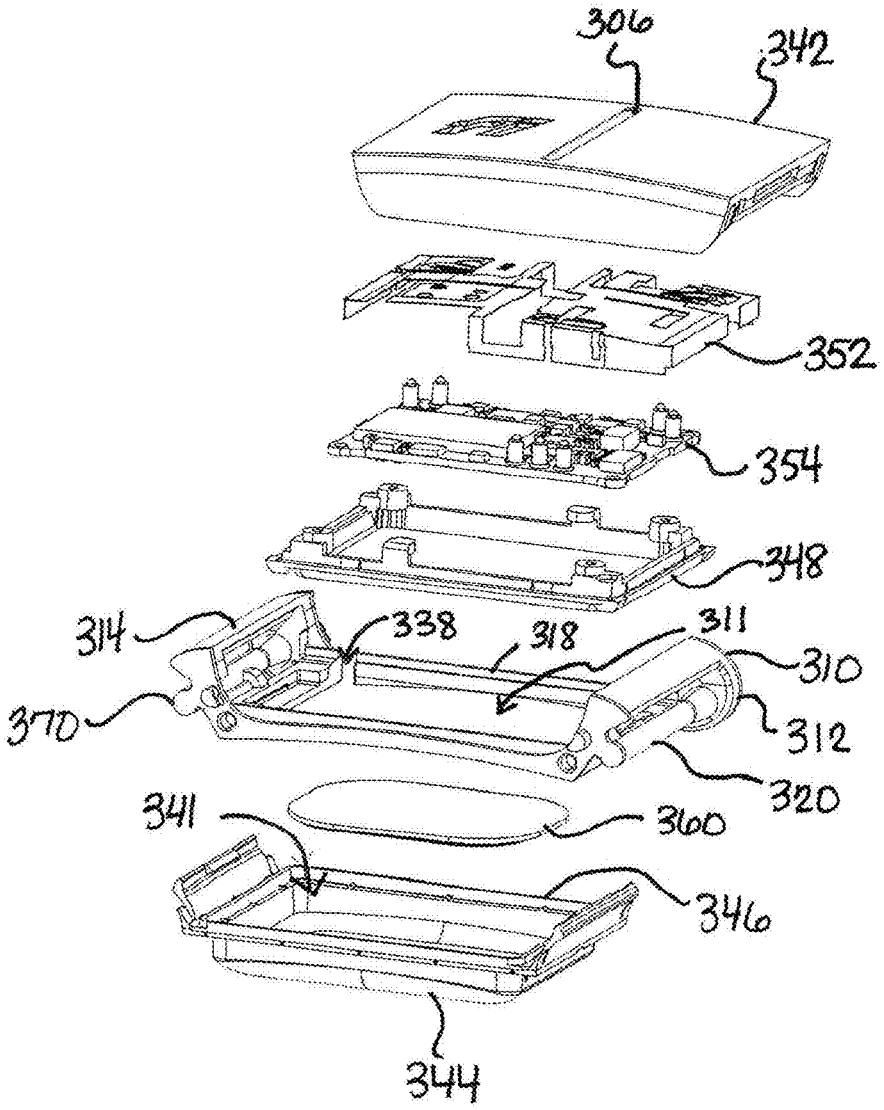
FIG. 7 is an exploded perspective view of an electronics module portion of the apparatus of FIG. 2.
Figure 8:
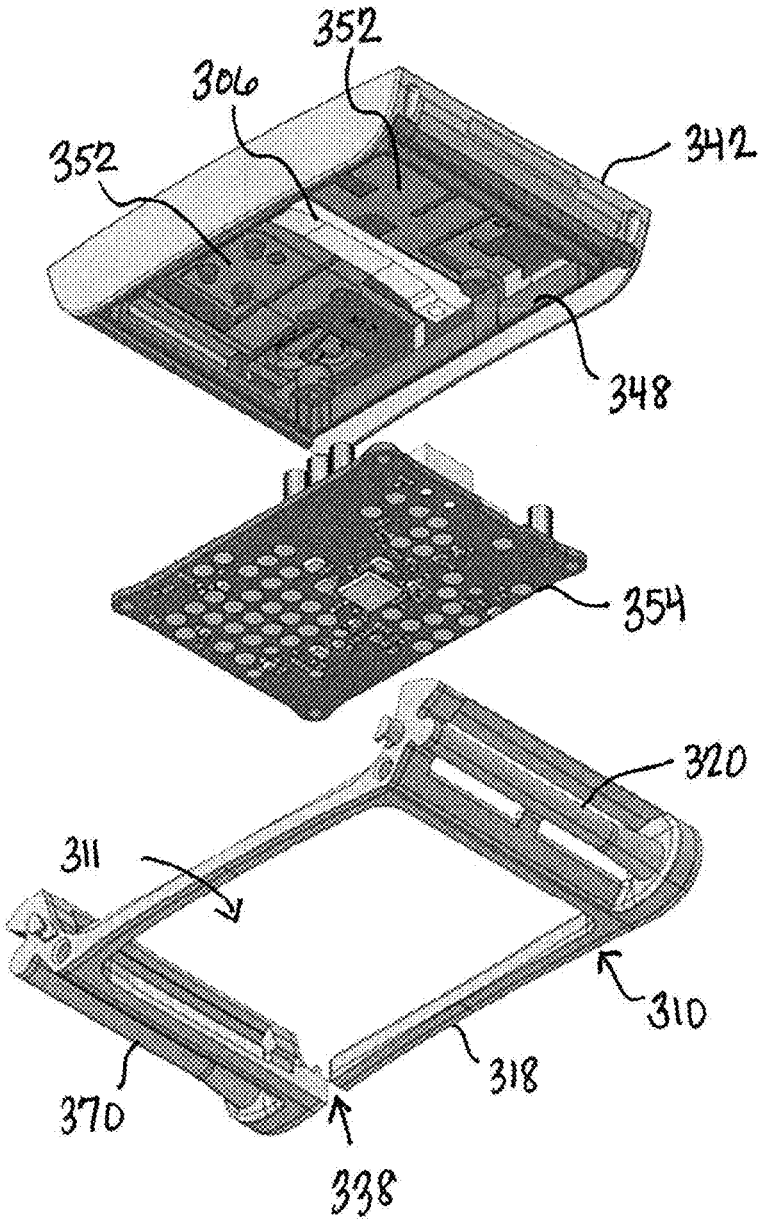
FIG. 8 is a partially exploded bottom perspective view of portions of the electronics module portion of FIG. 7, including a housing portion, an antenna element, a printed circuit board and a frame, according to an embodiment.

An apparatus 200 according to an embodiment is illustrated in FIGS. 2-8 (of these, FIGS. 4-6, the exploded view shown in FIG. 7, and the partially exploded view shown in FIG. 8 omit showing various features for the sake of clarity of illustration). The apparatus 200 can be, or can include components, similar in many respects or identical to apparatus 50. The apparatus 200 can include a wireless communications antenna included within a wearable electronic device, such as an electronic animal collar (or more specifically, an electronic dog collar, as shown in FIG. 2). Although the apparatus 200 is shown and described herein as being included in an electronic animal collar, in other embodiments, the apparatus 200 can be included in a different wearable electronic device, such as a watch (or smartwatch), an activity tracker, or the like.

The apparatus 200 can include an electronics module 300 and a band 400. Referring to FIGS. 4-6 and the exploded views of FIGS. 7-8, the electronics module 300 includes a housing 340, a printed circuit board 354 ("PCB"), and a frame 310. The housing 340 can have a top portion 342 and a bottom portion 344 coupled to the top portion 342, and can include a side wall portion 346 disposed between the top portion 342 and the bottom portion 344. The housing 340 can define an interior portion 341. For example, in some embodiments, one or more of the top portion 342, the bottom portion 344 and the side wall portion 346 of the housing collectively define the interior portion 341. The housing 340 can be constructed of any suitable material. For example, in some embodiments, the housing 340 is non-metal, such as a plastic, silicone, rubber, leather, or the like.

The electronics module 300 includes an antenna element 352. The PCB 354 and the antenna element 352 can be disposed between the housing 340 and the frame 310. In some embodiments, the top portion 342 of the housing 340 includes the antenna element 352. For example, the antenna element 352 can be coupled the top portion 342 of the housing 340, such as to an interior surface of the top portion 342. For example, the antenna element 352 can be a trace printed onto the interior surface of the top portion 342 of the housing 340.

The PCB 354 can be disposed between, and, optionally, not conductively coupled to, the housing 340 and the frame 310. The PCB 354 can be disposed within the interior portion 341 of the housing 340. The PCB 354 can be electrically or conductively coupled to the antenna element 352 included in the housing 340. In some embodiments, the PCB 354 can be inductively coupleable to the antenna element 352. In some embodiments, the PCB 354 can be capacitively coupled to the antenna element 352.

The frame 310 of the electronics module 300 can be at least partially disposed within the housing 340. In some embodiments, a body portion 318 of the frame 310 is disposed within the interior portion 341 of the housing 340, and at least a portion of opposing sides or end portions 312, 314 of the frame 310 can be disposed exterior to the housing 340.

The opposing sides or end portions 312, 314 of the frame 310 can each include a coupler 320, 370. The couplers 320, 370 can each be at least partially disposed external to the interior portion 341 of the housing 340, and more particularly external to the housing 40. The coupler 320 (e.g., a first coupler) is configured to be coupled to a first end portion 402 of the band 400, and the coupler 370 (e.g., second coupler) is configured to be coupled to a second end portion 404 of the band 400. In some embodiments, each end portion 402, 404 of the band 400 includes a coupler 100, 101, that is sized and configured to be removably coupled to the electronics module 300, and more specifically to removably couple to a respective one of the couplers 320, 370 of the frame 310.

The coupler 370 can be similar or substantially identical to (or a mirror image of) the coupler 320. Each coupler 320, 370 can include a first end 321, 371, respectively, and a second end 323, 373, respectively, opposite the first end. The coupler 320, 370 can be or include, for example, an elongated post. The elongated post can be slidingly receivable in a channel defined by the coupler 100, 101 of the band 400, for example, in a manner that permits the coupler 100, 101 of the band 400 to be rotated with respect to the coupler 320, 370 of the frame.

In some embodiments, the coupler 320, 370 of the frame 310 is conical, is cylindrical, or includes a first portion having a first shape (e.g., conical) and a second, mutually-exclusive portion having a second shape (e.g., cylindrical) different from the first shape. The coupler 320, 370 can have a shape complementary to a shape of the channel defined by the coupler 100, 101 of the band 400. In this manner, the shape of the coupler 320, 370 (or elongated post) and complementary shape of the coupler 100, 101 of the band 400 are collectively configured to ensure the end portions 402, 404 of the bands are coupled to a predetermined one of couplers 320, 370 (e.g., in a predetermined orientation). In some embodiments, the end portions 402, 404 of the band 400 must be positioned at a predetermined angle with respect to the coupler 320, 370, respectively, to be coupled to the electronics module 300.

The frame 310 can be constructed, for example, of metal. As such, the metal frame 310 can be electrically coupled to at least one of the antenna element 352 and the PCB 354, as described in more detail herein. In some embodiments, and as described in more detail herein, each of the couplers 320, 370 of the frame 310 can be constructed of metal and/or can include an electrically conductive material. The end portions 402, 404 of the band 400 (or, more specifically, couplers 100, 101) can also each be constructed of metal. Thus, in some embodiments, the first end portion 402 (or coupler 100) of the band 400 is conductively coupled to the metal frame 310 when removably coupled to the first coupler 320 of the metal frame 310, and the second end portion 404 (or coupler 101) of the band 404 is conductively coupled to the metal frame 310 when removably coupled to the second coupler 370 of the metal frame 310.

In some embodiments, the frame 310 includes at least one magnet 302, 303 adjacent to one of, or each of, the couplers 320, 370 of the frame 310. For example, the frame 310 can define a recess 332, 333 within which one of the magnets 302, 303, respectively, is received. The magnet 302 (or magnet 303) can be configured to generate or produce a magnetic field that attracts an end portion (e.g., first end portion 402 or second end portion 404, respectively) of the band 400. More specifically, the magnet 302, 303 can generate or produce a magnetic field that attracts a coupler 100, 101, respectively, of the band 400, or even more specifically, to attract a magnet (not shown) disposed on or otherwise coupled to the coupler 100, 101.

The antenna element 352, the metal frame 310, the first end portion 402 of the band 400 and the second end portion 404 of the band 400 can collectively define the antenna. The metal frame 310 can be electrically coupled to the antenna element 352 when the antenna is operational. Similarly, each of the first end portion 402 and the second end portion 404 of the band 400 can be electrically coupled to the antenna element 352 when the antenna is operational (e.g., when the electronics module 300 is powered on), and the end portions 402, 404 (or couplers 100, 101) are in sufficiently close proximity to or in contact with the electronics module 300.

In some embodiments, the antenna element 352 is electrically coupled to, but not directly in contact with, any one of the metal frame 310, the first end portion 402 of the band 400 and the second end portion 404 of the band 400, or a combination of the foregoing. In some embodiments, the metal frame 310, the first end portion 402 of the band 400 and the second end portion 404 of the band 400 are each indirectly electrically coupled to the antenna element 352. In some embodiments, any one of the metal frame 310, the first end portion 402 of the band 400 and the second end portion 404 of the band 400 can be inductively or capacitively coupled to the antenna element 352 when the antenna is operational. In some embodiments, the antenna element 352 is inductively, and not conductively, coupled to the metal frame 310, the first end portion 402 of the band 400 and the second end portion 404 of the band 400, collectively, or to any one of the foregoing individually.

The apparatus (or antenna) 200 can have a first configuration and a second configuration. In the first configuration, the first end portion 402 (or first coupler 100) of the band 400 is removably coupled to the first coupler 320 of the metal frame 310, and the second end portion 404 (or second coupler 101) of the band 400 is removably coupled to the second coupler 370 of the metal frame 310, as shown in FIG. 2. In the second configuration, the first end portion 402 (or first coupler 100) of the band 400 is not coupled to (or is spaced apart from) the first coupler 320 of the metal frame 310, and the second end portion 404 (or second coupler 101) of the band 400 is not coupled to (or is spaced apart from) the second coupler 370 of the metal frame 310, as shown in FIG. 3.

The antenna has an antenna profile when the antenna is operational. For example, the antenna, when operational, can have an antenna profile that includes a predetermined spatial radiation pattern, a predetermined frequency response (e.g., bandwidth) and a predetermined peak magnitude. In some embodiments, when the antenna is in the first configuration as shown in FIG. 2 and the antenna is operational, the antenna has a first spatial radiation pattern and a first frequency response, which can include a first peak magnitude. The first spatial radiation pattern can represent, for example, directional (angular) strength of the output (and reception) of the antenna. The first frequency response can include, for example, a predetermined frequency range (e.g., a first bandwidth), and the first peak magnitude can reflect a quality of the resonance (i.e., radiation efficiency). In use, for example, operation of the antenna in the first configuration can be sufficient or desirable to enable the antenna to transmit a signal to and/or receive a signal from a remote electronic device. In this manner, the antenna in the first configuration can be used for remote tracking of the geolocation of the wearable electronic device, such as GPS tracking via a cellular tower, WiFi®, a smartphone, or other suitable system or remote electronic device.

In some implementations, when the antenna is in the second configuration as shown in FIG. 3 and the antenna is operational, the antenna can have a second spatial radiation pattern and a second frequency response, which can include a second peak magnitude. The second spatial radiation pattern can represent, for example, directional (angular) strength of the output (and reception) of the antenna when in the second configuration. In some implementations, the second spatial radiation pattern and/or the second frequency response can include or correspond to, for example, the first spatial radiation pattern and/or the first frequency response. In other implementations, the second spatial radiation pattern and/or the second frequency response can be different from the first spatial radiation pattern and/or the first frequency response, such as by having a different resonance quality and/or characteristic(s). For example, the second peak magnitude can be different from, such as less than, the first peak magnitude. As such, the second peak magnitude can reflect a lesser quality of resonance than the quality of resonance reflected by the first peak magnitude. In use, for example, operation of the antenna in the second configuration can be insufficient or undesirable for the antenna to transmit a signal to and/or receive a signal from a remote electronic device. In this manner, the antenna in the second configuration can interfere with remote tracking of the geolocation of the wearable electronic device.

As shown in FIGS. 6-8, in some embodiments, the frame 310 includes a cut-out portion 338 pre-selected to tune a spatial radiation pattern and/or a frequency response of the antenna, when the antenna is operational. Said another way, the cut-out portion 338 can be sized and positioned to tune the spatial radiation pattern and/or the frequency response of the antenna. For example, the metal frame 310 can include the cut-out portion 338 pre-selected to tune the first spatial radiation pattern, the first frequency response and/or the first peak magnitude of the first frequency response of the antenna when the antenna is operational and when the first and second end portions 402, 404 of the band 400 are removably coupled to respective first and second couplers 320, 370 of the metal frame 310 (i.e., the antenna is in the first configuration). The cut-out portion 338 can extend across a side of the frame 310, for example from an outer surface of the body portion 318 of the frame to an opening 311 defined by the frame and within which the bottom portion 344 of the housing 430 is received (see, e.g., FIGS. 5-8).

Figure 9:
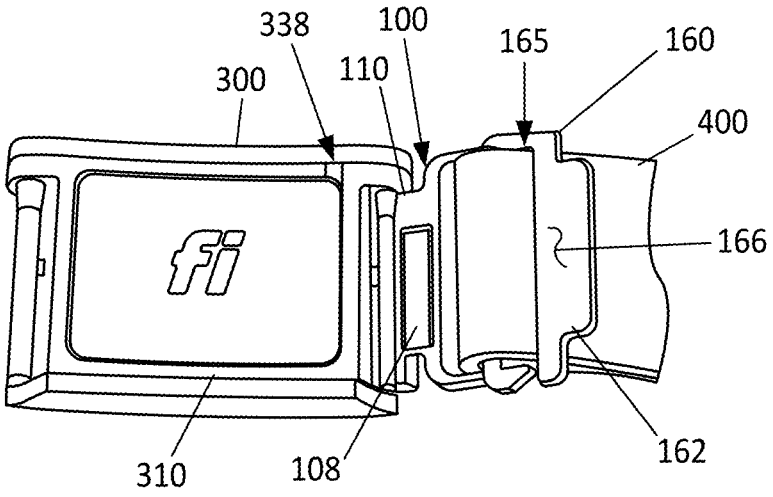
FIG. 9 is a bottom view of a portion of the apparatus of FIG. 2 with a locking clip in a first position, according to an embodiment.
Figure 10:
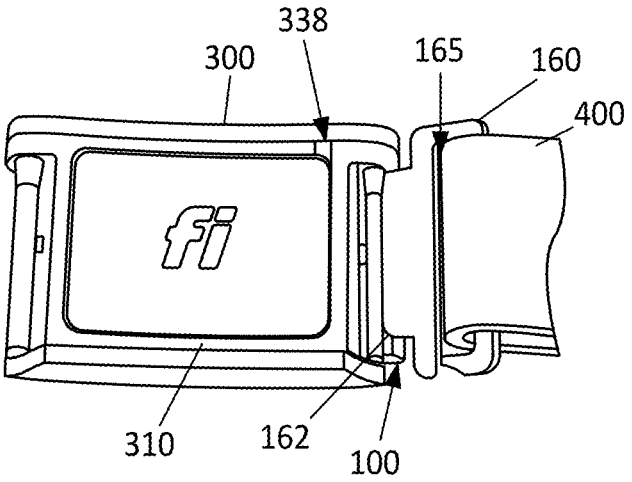
FIG. 10 is a bottom view of the portion of the apparatus of FIG. 2 with the locking clip of FIG. 9 in a second position, according to an embodiment.

In some embodiments, any of the apparatus described herein can include a locking element (e.g., a clip, stopper, fastener or other suitable locking element) configured to be selectively engaged to prevent rotation of a coupler described herein to a predetermined angle with respect to an electronics module described herein, at which the coupler can be uncoupled from the electronics module 300, when the locking element is engaged. For example, referring to FIG. 9, a clip 160 (or locking clip) can be coupled to the band 400 (e.g., the clip 160 can define an elongate slot 165 that is sized and shaped for a portion of the band 400 to be disposed therethrough. In use, the clip 160 is movable (e.g., rotatable) from a first position (e.g., as shown in FIG. 9) in which a first side portion 162 of the clip 160 is spaced apart from the coupler 100, to a second position (e.g., as shown in FIG. 10) in which the first side portion 162 of the clip 160 (e.g., a first surface 166 of the first side portion 162) is in contact with the body portion 110 of the coupler 100. The clip 160, or at least the first side portion 162 thereof, can be at least partially constructed of metal. The first side portion 162 can be removably coupled to the body portion 110 of the coupler 100, for example, by magnetic attraction of the metal clip 160 to the magnet 108.

Because the locking clip 160 can be at least partially constructed of metal, the locking clip 160 can be considered as part of the antenna and thus can affect the antenna profile of the antenna. For an implementation without the locking clip 160, the antenna can be defined by the collection of the antenna element 352 (not shown in FIG. 9), the metal frame 310, the first end portion 402 (or coupler 100) of the band 400 and the second end portion 404 (or coupler 101, not show) of the band 400 (not shown in FIG. 9); for the implementation with the locking clip 160, the antenna can be defined by the collection of the locking clip 160, the antenna element 352, the metal frame 310, the coupler 100 of the band 400 and the other coupler 101 of the band 400. Accordingly, the cut-out portion 338 of the frame 310 can be pre-selected (e.g., sized and positioned) to tune the spatial radiation pattern and/or the frequency response of the antenna when the locking clip 160 is in the second position. For example, the metal frame 310 can include the cut-out portion 338 pre-selected to tune the first spatial radiation pattern, the first frequency response and/or the first peak magnitude of the first frequency response of the antenna when the antenna is operational and when the first and second end portions 402, 404 of the band 400 are removably coupled to respective first and second couplers 320, 370 of the metal frame 310 (i.e., the antenna is in the first configuration) and when the locking clip 160 is in the second position.

Figure 11:
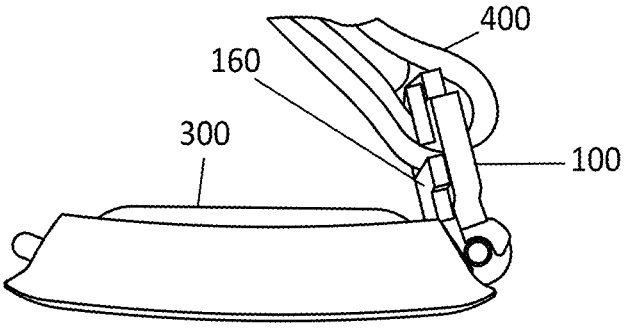
FIG. 11 is a side view of the portion of the apparatus of FIG. 2 and with the locking clip of FIG. 9 in the second position.

FIG. 11 illustrates that the clip 160 provides a physical barrier that prevents complete rotation of the coupler to a predetermined angle at which the coupler can be uncoupled from the electronics module 300. In this manner, the clip 160 is configured be selectively engaged to help prevent inadvertent decoupling of the coupler 100 from the electronics module 300. To remove the coupler 100 from the electronics module 300, the clip 160 is moved by a user from the second position to or towards the clip's first position, thereby permitting the coupler 100 to be fully moved to the coupler's first position and subsequently uncoupled from the electronics module.

A portion of the band 400 between the first end portion 402 and the second end portion 404 of the band 400 can be constructed, for example, of a non-conductive material. The band 400 can include an elongate material between the first end portion 402 (or first coupler 100) and the second end portion 404 (or second coupler 101). The elongate material can be flexible. The elongate material can be any suitable material configured to be worn by a user, such as nylon, cotton, polyester, leather, or other suitable woven or non-woven material.

The band 400 can have an adjustable length. More specifically, the elongate material of the band 400 can be adjustable to a length. For example, the band 400 can include a ladder lock buckle 420, or the like, disposed between the first end portion 402 and the second end portion 404 of the band 400. In another example, the band 400 can be looped through an attachment portion of the coupler 100, 101 and adjustably coupled back on itself using, for example, a hook and loop fastener, snaps, a buckle, or the like. The band 400 can include a buckle 430 disposed between the first end portion 402 and the second end portion 404. The buckle 430 can, for example, include a male portion 432 and a female portion 434 configured to matingly engage with the male portion 432. In this manner, the buckle 430 is configured to open the band 400 of the wearable electronic device for attaching to or donning by a user (e.g., without decoupling one of coupler 100, 101 and frame coupler 320, 370, respectively). The band 400 can optionally include a ring (e.g., a D-ring 406, as shown in FIG. 2, an O-ring, or the like) configured to be removably coupled to a leash, identification tag, or the like, or any other suitable article.

The electronics module 300 can include additional components. For example, in some embodiments, the electronics module 300 can include a battery 364, a charging coil 360 coupled to the battery 364, electrical connectors or wires 362, a light source 306, each of which can be at least partially disposed in the interior portion 341 of the housing 340. The light source 306 can be coupled to the top portion 342 of the housing 340, and a portion of the light source 306 can be disposed within an aperture defined by the top portion 342 of the housing 340 such that the light source is externally visible. In this manner, illumination of the light source 306 can be used to indicate an operating condition of the electronics module 300 (e.g., light on when the module is powered on, light off when the module is powered off, a first color light when the battery has a threshold charge and a second color light when the battery has less than a threshold charge, a predetermined color or blinking light to indicate an error, or the like, or any combination of the foregoing).

In some embodiments, the electronics module 300 includes a housing support frame 348 at least partially disposed within the interior portion 341 of the housing 340. The housing support frame 348 can be disposed about a perimeter of the PCB 354, and can be configured to help couple the PCB 354 to the housing 340 (e.g., to the top portion 342 of the housing, such as with screws or another suitable fastener). In some embodiments, the housing support frame 348 is physically disposed between the perimeter of the PCB 354 and a frame 310 of the electronics module 300 (e.g., so that the PCB 354 does not directly contact the frame 310). The housing support frame 348 can be configured to help physically separate the PCB 354 from the battery 364 within the interior portion 341 of the housing 340.

In some implementations, as shown in FIGS. 4 and 6, the electronics module 300 can include a first frame support 390 and/or a second frame support 392, each coupled to a portion of the housing 340. The frame support 390, 392 can be configured to help couple together components of the electronics module 300 (e.g., the top portion 342 of the housing 340, the bottom portion 344 of the housing, and/or the frame 310). In some implementations, the frame supports are positioned to limit entry of dirt and debris into the interior portion 341 of the housing 340, such as via narrow openings between housing portions and/or the frame 310.

In some implementations, one or more portions of the electronics module 300 described herein (e.g., frame 310) can be monolithically constructed. For example, the couplers 320, 370 can be monolithically formed with a body portion of the frame 310 between the couplers. In other implementations, one or more portions of the frame 310 (e.g., the couplers 320, 370) can be separately formed or constructed and attached to the other portion(s) of the frame 310.

Figure 12:
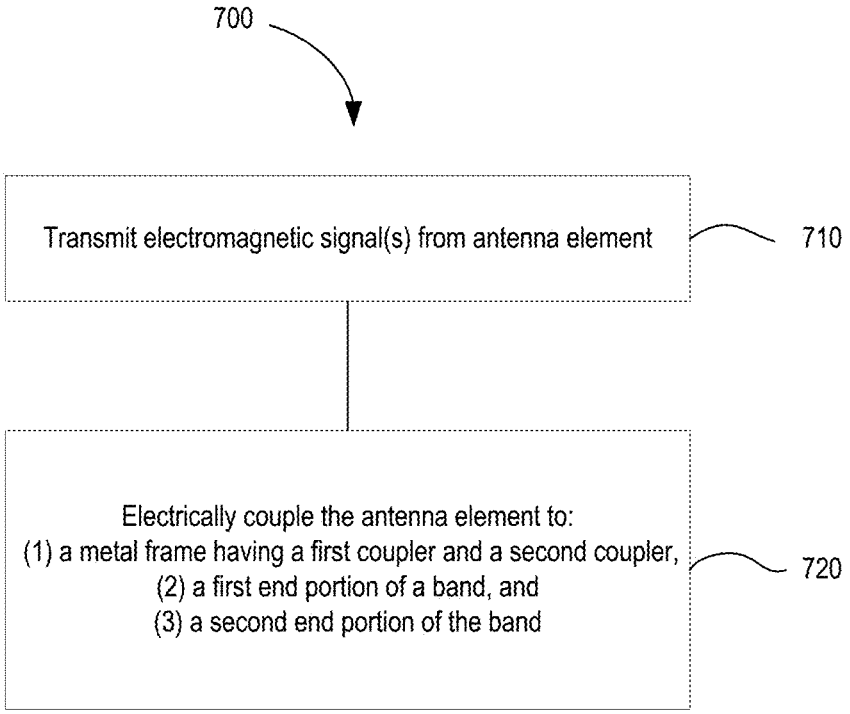
FIG. 12 is a flowchart of a method, according to an embodiment.

A flowchart of a method 700 according to an embodiment is illustrated in FIG. 12. The method can be implemented, for example, using any of the apparatus 200, described herein. At 710, the method 700 includes transmitting an electromagnetic signal(s) from an antenna element (e.g., antenna element 54, antenna element 352) coupled to a top portion (e.g., top portion 342) of a housing (e.g., housing 52, housing 340). The signal can be transmitted, for example, from an electronics module (e.g., electronics module 30, 300) to a cellular tower, smartphone, or other suitable electronic device, as described herein.

At 720, the method 700 includes electrically coupling the antenna element to a metal frame (e.g., frame 20, frame 310) having a first coupler and a second coupler, to a first end portion of a band and to a second end portion of the band. The antenna element can be coupled to the top portion 342 of the housing 340 and not be directly coupled to the metal frame. The first end portion of the band can be conductively coupled to the metal frame and removably coupled to the first coupler of the metal frame, and the second end portion of the band can be conductively coupled to the metal frame and removably coupled to the second coupler of the metal frame.

In some embodiments, the antenna element, the metal frame (e.g., frame 20, 310), the first end portion (e.g., end portion 10, 402, or more particularly, coupler 100) of the band (e.g., band 40, 400) and the second end portion (e.g., end portion 11, 404, or more particularly, coupler 101) of the band collectively define an antenna having an antenna profile when the antenna is operational. The metal frame (e.g., frame 20, 310) can include a cut-out portion (e.g., cut-out portion 338) pre-selected to tune a peak magnitude of a frequency response of the antenna when the antenna is operational. The housing (e.g., housing 42, 340) can be non-metal. The metal frame, the first end portion of the band and the second end portion of the band can each be indirectly electrically coupled to the antenna element. Said another way, the antenna element can be not directly coupled to or in contact with the first end portion of the band and the second end portion of the band.

While various embodiments have been described above, it should be understood that they have been presented by way of example only, and not limitation. Where schematics and/or embodiments described above indicate certain components arranged in certain orientations or positions, the arrangement of components may be modified. While the embodiments have been particularly shown and described, it will be understood that various changes in form and details may be made. Although various embodiments have been described as having particular features and/or combinations of components, other embodiments are possible having any combination or sub-combination of any features and/or components from any of the embodiments described herein. Further, although methods have been described herein in reference to a specific embodiment, the methods can be executed using any suitable device embodiment described herein.

For example, although the housing has been described herein as being non-metal, in some embodiments, the housing can be at least partially constructed of metal, and the housing can help collectively form the antenna, with the other components described herein.

In another example, although the frame (e.g., frame 310) is shown and described herein as being distinct from the housing 340, in some embodiments, one or more portions of the housing and the frame can be integrally or monolithically constructed. For example, in some embodiments, the housing can include couplers similar to the any of the couplers (e.g., couplers 320, 370) described herein.

Although the antenna element has been described herein as transmitting a signal, in some implementations, the antenna element can also receive a signal at the electronics module, such as from a cellular tower, smartphone, or other suitable electronic device described herein. For example, in some implementations, the electronics module can receive a signal associated with a software update, a signal associated with an audio alert (e.g., an audible beep or the like to warn the animal that they have exceeded or are approaching a predetermined distance from a base location or other boundary), a signal associated with a verbal command (e.g., an owner's voice with a "stay" command).

In some implementations, an apparatus can comprise a housing that has a top portion and a bottom portion. The top portion of the housing can include an antenna element. The apparatus can also comprise a printed circuit board (PCB) and a metal frame that has a first coupler and a second coupler. The PCB can be disposed between and not conductively coupled to the housing and the metal frame. The PCB can be conductively coupled to the antenna element. The apparatus can also comprise a band that has having a first end portion and a second end portion. The first end portion of the band can be conductively coupled to the metal frame when removably coupled to the first coupler of the metal frame. The second end portion of the band can be conductively coupled to the metal frame when removably coupled to the second coupler of the metal frame. The antenna element, the metal frame, the first end portion of the band and the second end portion of the band can collectively define an antenna having an antenna profile when the antenna is operational.

In some implementations, the metal frame can include a cut-out portion pre-selected to tune a peak magnitude of a frequency response of the antenna when the antenna is operational.

In some implementations, the antenna can have a first peak magnitude when the antenna is operational, when the first end portion of the band is removably coupled to the first coupler of the metal frame, and when the second end portion of the band is removably coupled to the second coupler of the metal frame. The antenna can have a second peak magnitude when the antenna is operational, when the first end portion of the band is not coupled to the first coupler of the metal frame, and when the second end portion of the band is not coupled to the second coupler of the metal frame. The first peak magnitude can be different from the second peak magnitude.

In some implementations, the metal frame can include a cut-out portion pre-selected to tune a first peak magnitude of the antenna when the antenna is operational, when the first end portion of the band is removably coupled to the first coupler of the metal frame, and when the second end portion of the band is removably coupled to the second coupler of the metal frame. The antenna can have a second peak magnitude when the antenna is operational, when the first end portion of the band is not coupled to the first coupler of the metal frame, and when the second end portion of the band is not coupled to the second coupler of the metal frame. The first peak magnitude can be different from the second peak magnitude. The first frequency response can be different from the second frequency response.

In some implementations, the housing can be non-metal. The metal frame, the first end portion of the band and the second end portion of the band each can be electrically coupled to the antenna element when the antenna is operational.

In some implementations, the antenna element can be electrically coupled and not directly coupled to any one of the metal frame, the first end portion of the band and the second end portion of the band.

In some implementations, the housing includes a side wall portion. The top portion of the housing, the bottom portion of the housing and the side wall portion of the housing collectively can define an interior portion within which the antenna and the PCB are disposed.

In some implementations, the housing includes a side wall portion. The top portion of the housing, the bottom portion of the housing and the side wall portion of the housing collectively can define an interior portion within which the antenna and the PCB are disposed, and the metal frame can be fixedly coupled to the side wall portion of the housing.

In some implementations, an apparatus can comprise a band that has a first metal coupler, a second metal coupler and an elongate material disposed between the first metal coupler and the second metal coupler. The first metal coupler and the second metal coupler can each be sized and configured to be removably coupled to an electronics module having a printed circuit board (PCB) and an antenna element conductively coupled to the PCB. The PCB and the antenna element can be disposed between a housing and a metal frame. The antenna element, the metal frame, the first metal coupler and the second metal coupler collectively can define an antenna having an antenna profile when the antenna is operational and when the band is removably coupled to the electronics module.

In some implementations, the elongate material of the band can be adjustable to a length.

In some implementations, the metal frame can include a first coupler and a second coupler opposite the first coupler. The first coupler of the band can be sized and configured to removably couple to the first coupler of the metal frame. The second coupler of the band can be sized and configured to removably couple to the second coupler of the metal frame.

In some implementations, the antenna can have a first peak magnitude when the antenna is operational, when the first end portion of the band is removably coupled to the first coupler of the metal frame, and when the second end portion of the band is removably coupled to the second coupler of the metal frame. The antenna can have a second peak magnitude when the antenna is operational, when the first end portion of the band is not coupled to the first coupler of the metal frame, and when the second end portion of the band is not coupled to the second coupler of the metal frame. The first peak magnitude can be different from the second peak magnitude.

In some implementations, the metal frame can include a cut-out portion pre-selected to tune a first peak magnitude of the antenna when the antenna is operational, when the first end portion of the band is removably coupled to the first coupler of the metal frame, and when the second end portion of the band is removably coupled to the second coupler of the metal frame. The antenna can have a second peak magnitude when the antenna is operational, when the first end portion of the band is not coupled to the first coupler of the metal frame, and when the second end portion of the band is not coupled to the second coupler of the metal frame. The first peak magnitude can be different from the second peak magnitude.

In some implementations, the housing can be non-metal. The metal frame, the first end portion of the band and the second end portion of the band can each be electrically coupled to the antenna element when the antenna is operational.

In some implementations, the antenna element can be electrically coupled and not directly coupled to any one of the metal frame, the first end portion of the band and the second end portion of the band.

In some implementations, a method comprises transmitting an electromagnetic signal from an antenna element coupled to a top portion of a housing. The method can also comprise electrically coupling the antenna element to (1) a metal frame having a first coupler and a second coupler, (2) a first end portion of a band, and (3) a second end portion of the band. The antenna element can be not directly coupled to the metal frame. The first end portion of the band can be conductively coupled to the metal frame and removably coupled to the first coupler of the metal frame. The second end portion of the band can be conductively coupled to the metal frame and removably coupled to the second coupler of the metal frame.

In some implementations, the antenna element, the metal frame, the first end portion of the band and the second end portion of the band can collectively define an antenna having an antenna profile when the antenna is operational.

In some implementations, the metal frame can include a cut-out portion pre-selected to tune a peak magnitude of a frequency response of the antenna when the antenna is operational.

In some implementations, the housing can be non-metal. The metal frame, the first end portion of the band and the second end portion of the band can each be indirectly electrically coupled to the antenna element.

In some implementations, the antenna element can be not directly coupled to the first end portion of the band and the second end portion of the band.

As used in this specification and the appended claims, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "reversible," "reversibly," and/or the like when used to described a process and/or procedure generally refer to a non-destructive process or procedure that can be subsequently undone by a similar yet substantially opposed, inverse, and/or opposite non-destructive process or procedure. When used herein with respect to attachment and/or detachment of an element or assembly, a reversible attachment refers to a non-destructive, repeatable attachment and/or detachment of the element or assembly.

As used herein, the terms "about" and/or "approximately" when used in conjunction with numerical values and/or ranges generally refer to those numerical values and/or ranges near to a recited numerical value and/or range. For example, in some instances, "about 40 [units]" can mean within ±25% of 40 (e.g., from 30 to 50). In some instances, the terms "about" and "approximately" can mean within ±10% of the recited value. In other instances, the terms "about" and "approximately" can mean within ±9%, ±8%, ±7%, ±6%, ±5%, ±4%, ±3%, ±2%, ±1%, less than ±1%, or any other value or range of values therein or therebelow. The terms "about" and "approximately" may be used interchangeably. Furthermore, although a numerical value modified by the term "about" or "approximately" can allow for and/or otherwise encompass a tolerance of the stated numerical value, it is not intended to exclude the exact numerical value stated.

In a similar manner, term "substantially" when used in connection with, for example, a geometric relationship, a numerical value, and/or a range is intended to convey that the geometric relationship (or the structures described thereby), the number, and/or the range so defined is nominally the recited geometric relationship, number, and/or range. For example, two structures described herein as being "substantially non-parallel" is intended to convey that, although a non-parallel geometric relationship is desirable, some parallelism can occur in a "substantially non-parallel" arrangement. By way of another example, a structure defining a diameter that is "substantially 100 millimeters (mm)" is intended to convey that, while the recited diameter is desirable, some tolerances can occur when the volume is "substantially" the recited volume (e.g., 100 mm). Such tolerances can result from manufacturing tolerances, measurement tolerances, and/or other practical considerations (such as, for example, minute imperfections, age of a structure so defined, a pressure or a force exerted within a system, and/or the like). As described above, a suitable tolerance can be, for example, of ±1%, ±2%, ±3%, ±4%, ±5%, ±6%, ±7%, ±8%, ±9%, ±10%, or more of the stated geometric construction, numerical value, and/or range. Furthermore, although a numerical value modified by the term "substantially" can allow for and/or otherwise encompass a tolerance of the stated numerical value, it is not intended to exclude the exact numerical value stated.

While numerical ranges may be provided for certain quantities, it is to be understood that these ranges can include all subranges therein. Thus, the range "from 45 to 135" includes all possible ranges therein (e.g., 46-134, 47-133, 48-132, 49-131, . . . , 89-91, etc.). Furthermore, all values within a given range may be an endpoint for the range encompassed thereby (e.g., the range 45 to 135 includes the ranges with endpoints such as 90-135, 45-90, etc.).

The devices described herein, and various components thereof, can be constructed of any suitable material. For example, in some embodiments, the . . . , or other portion of a device herein can be constructed of nylon or another suitable material.

The specific configurations of the various components described herein can also be varied. For example, the size and specific shape of the various components can be different from the embodiments shown, while still providing the functions as described herein. Additionally, the relative size of various components of the devices shown and described herein with respect to the size of other components of the devices are not necessarily to scale.

Similarly, where methods and/or events described above indicate certain events and/or procedures occurring in certain order, the ordering of certain events and/or procedures may be modified. While the embodiments have been particularly shown and described, it will be understood that various changes in form and details may be made.

What is claimed is:

1. An apparatus, comprising:

a housing having a top portion and a bottom portion, the top portion of the housing including an antenna element;

a printed circuit board (PCB);

a metal frame having a first coupler and a second coupler, the PCB being disposed between and not conductively coupled to the housing and the metal frame, the PCB conductively coupled to the antenna element; and a band having a first end portion and a second end portion, the first end portion of the band being conductively coupled to the metal frame when removably coupled to the first coupler of the metal frame, the second end portion of the band being conductively coupled to the metal frame when removably coupled to the second coupler of the metal frame, the antenna element, the metal frame, the first end portion of the band and the second end portion of the band collectively defining an antenna having an antenna profile when the antenna is operational, the antenna having a first peak magnitude when the antenna is operational, when the first end portion of the band is removably coupled to the first coupler of the metal frame, and when the second end portion of the band is removably coupled to the second coupler of the metal frame, the antenna having a second peak magnitude when the antenna is operational, when the first end portion of the band is not coupled to the first coupler of the metal frame, and when the second end portion of the band is not coupled to the second coupler of the metal frame, the first peak magnitude being different from the second peak magnitude.

2. The apparatus of claim 1, wherein the metal frame includes a cut-out portion pre-selected to tune the first peak magnitude of a frequency response of the antenna when the antenna is operational, when the first end portion of the band is removably coupled to the first coupler of the metal frame, and when the second end portion of the band is removably coupled to the second coupler of the metal frame.

3. An apparatus, comprising:

a housing having a top portion and a bottom portion, the top portion of the housing including an antenna element;

a printed circuit board (PCB);

a metal frame having a first coupler and a second coupler, the PCB being disposed between and not conductively coupled to the housing and the metal frame, the PCB conductively coupled to the antenna element; and a band having a first end portion and a second end portion, the first end portion of the band being conductively coupled to the metal frame when removably coupled to the first coupler of the metal frame, the second end portion of the band being conductively coupled to the metal frame when removably coupled to the second coupler of the metal frame, the antenna element, the metal frame, the first end portion of the band and the second end portion of the band collectively defining an antenna having an antenna profile when the antenna is operational, the metal frame including a cut-out portion pre-selected to tune a first peak magnitude of the antenna when the antenna is operational, when the first end portion of the band is removably coupled to the first coupler of the metal frame, and when the second end portion of the band is removably coupled to the second coupler of the metal frame, and the antenna having a second peak magnitude when the antenna is operational, when the first end portion of the band is not coupled to the first coupler of the metal frame, and when the second end portion of the band is not coupled to the second coupler of the metal frame, the first peak magnitude being different from the second peak magnitude.

4. The apparatus of claim 1, wherein:

the housing is non-metal, the metal frame, the first end portion of the band and the second end portion of the band each are electrically coupled to the antenna element when the antenna is operational.

5. The apparatus of claim 1, wherein the antenna element is electrically coupled and not directly coupled to any one of the metal frame, the first end portion of the band and the second end portion of the band.

6. The apparatus of claim 1, wherein:

the housing includes a side wall portion, and the top portion of the housing, the bottom portion of the housing and the side wall portion of the housing collectively defining an interior portion within which the antenna and the PCB are disposed.

7. The apparatus of claim 1, wherein:

the housing includes a side wall portion, the top portion of the housing, the bottom portion of the housing and the side wall portion of the housing collectively defining an interior portion within which the antenna and the PCB are disposed, and the metal frame is fixedly coupled to the side wall portion of the housing.

8. An apparatus, comprising:

a band having a first metal coupler, a second metal coupler and an elongate material disposed between the first metal coupler and the second metal coupler, the first metal coupler and the second metal coupler each sized and configured to be removably coupled to an electronics module having a printed circuit board (PCB) and an antenna element conductively coupled to the PCB, the PCB and the antenna element being disposed between a housing and a metal frame, the antenna element, the metal frame, the first metal coupler and the second metal coupler collectively defining an antenna having an antenna profile when the antenna is operational and when the band is removably coupled to the electronics module, the antenna having a first peak magnitude when the antenna is operational, when the first end portion of the band is removably coupled to the first coupler of the metal frame, and when the second end portion of the band is removably coupled to the second coupler of the metal frame, the antenna having a second peak magnitude when the antenna is operational, when the first end portion of the band is not coupled to the first coupler of the metal frame, and when the second end portion of the band is not coupled to the second coupler of the metal frame, the first peak magnitude being different from the second peak magnitude.

9. The apparatus of claim 8, wherein the elongate material of the band is adjustable to a length.

10. The apparatus of claim 8, wherein the metal frame includes a first coupler and a second coupler opposite the first coupler, the first coupler of the band sized and configured to removably couple to the first coupler of the metal frame, the second coupler of the band sized and configured to removably couple to the second coupler of the metal frame.

11. The apparatus of claim 8, wherein:

the metal frame includes a cut-out portion pre-selected to tune the first peak magnitude of the antenna.

12. The apparatus of claim 8, wherein:

the housing is non-metal, the metal frame, the first end portion of the band and the second end portion of the band each being electrically coupled to the antenna element when the antenna is operational.

13. The apparatus of claim 8, wherein the antenna element is electrically coupled and not directly coupled to any one of the metal frame, the first end portion of the band and the second end portion of the band.

14. A method, comprising:

transmitting an electromagnetic signal from an antenna element coupled to a top portion of a housing; and electrically coupling the antenna element to (1) a metal frame having a first coupler and a second coupler, (2) a first end portion of a band, and (3) a second end portion of the band, the antenna element not being directly coupled to the metal frame, the first end portion of the band conductively coupled to the metal frame and removably coupled to the first coupler of the metal frame, the second end portion of the band conductively coupled to the metal frame and removably coupled to the second coupler of the metal frame, the electromagnetic signal having a first peak magnitude after the electrically coupling and having a second peak magnitude before the electrically coupling, the first peak magnitude being different from the second peak magnitude.

15. The method of claim 14, wherein:

the antenna element is conductively coupled to a printed circuit board (PCB), the PCB is disposed between and not conductively coupled to the housing and the metal frame, the PCB is conductively coupled to the antenna element, the housing includes a bottom portion and side wall portion, and the top portion of the housing, the bottom portion of the housing and the side wall portion of the housing collectively define an interior portion within which the antenna element and the PCB are disposed.

16. The method of claim 14, wherein the metal frame includes a cut-out portion pre-selected to tune the first peak magnitude of a frequency response of the antenna.

17. The method of claim 14, wherein:

the housing is non-metal, the metal frame, the first end portion of the band and the second end portion of the band are each indirectly electrically coupled to the antenna element.

18. The method of claim 14, wherein the antenna element is not directly coupled to the first end portion of the band and the second end portion of the band.

* * * * *